US010465440B2

(12) United States Patent
Miller et al.

(10) Patent No.: US 10,465,440 B2
(45) Date of Patent: Nov. 5, 2019

(54) SHUTTER SLAT

(71) Applicants: James V. Miller, Glen Ellyn, IL (US); Brian Peterson, Glen Ellyn, IL (US)

(72) Inventors: James V. Miller, Glen Ellyn, IL (US); Brian Peterson, Glen Ellyn, IL (US)

(73) Assignee: Qualitas Manufacturing Incorporated, Itasca, IL (US)

( * ) Notice: Subject to any disclaimer, the term of this patent is extended or adjusted under 35 U.S.C. 154(b) by 0 days.

(21) Appl. No.: 14/575,529

(22) Filed: Dec. 18, 2014

(65) Prior Publication Data

US 2015/0101762 A1 Apr. 16, 2015

Related U.S. Application Data

(63) Continuation-in-part of application No. 13/772,154, filed on Feb. 20, 2013, now Pat. No. 8,944,137.

(60) Provisional application No. 61/600,909, filed on Feb. 20, 2012.

(51) Int. Cl.

| | |
|---|---|
| ***E06B 9/15*** | (2006.01) |
| ***E06B 9/171*** | (2006.01) |
| ***E06B 9/58*** | (2006.01) |

(52) U.S. Cl.

CPC ..... *E06B 9/171* (2013.01); *E06B 9/15* (2013.01); *E06B 9/581* (2013.01); *E06B 2009/1522* (2013.01); *E06B 2009/1544* (2013.01); *E06B 2009/1716* (2013.01)

(58) Field of Classification Search

CPC ..... E06B 2009/1544; E06B 2009/1538; E06B 2009/1533; E06B 2009/1505; E06B 9/08; E06B 2009/1522; E06B 2009/1566; E06B 9/11

USPC ..... 160/235, 236, 133

See application file for complete search history.

(56) References Cited

U.S. PATENT DOCUMENTS

| | | | | |
|---|---|---|---|---|
| 638,314 | A | 12/1899 | Blades | |
| 845,526 | A | 2/1907 | Collins | |
| 876,593 | A | 1/1908 | Rush | |
| 1,014,315 | A | 1/1912 | McCloud | |
| 1,352,656 | A | 9/1920 | Cahill | |
| 1,579,839 | A | 4/1926 | Raper | |
| 1,720,850 | A * | 7/1929 | Negrini | E06B 9/15 160/133 |
| 1,776,119 | A | 9/1930 | Johnson | |
| 1,892,570 | A | 12/1932 | Ginder | |
| 1,918,415 | A | 7/1933 | Miller | |
| 2,350,287 | A | 5/1944 | Michelman | |

(Continued)

FOREIGN PATENT DOCUMENTS

| | | | |
|---|---|---|---|
| JP | 2010525195 | A | 7/2010 |
| JP | 2013151813 | A | 8/2013 |

*Primary Examiner* — Katherine W Mitchell
*Assistant Examiner* — Jeremy C Ramsey
(74) *Attorney, Agent, or Firm* — Ice Miller LLP

(57) ABSTRACT

A slat for use in a rolling shutter is provided. The slat comprises a hooking track located at a first edge of a body and a receiving track located at a second edge of the body. Illustratively, the hooking track has a hook-shaped profile, and the receiving track comprises a lip member and a guard member defining a space adapted to receive therein an engaging track of an adjacent slat. The hooking track and the receiving track are designed to minimize the space required for the rolling shutter to be retracted around a spindle.

18 Claims, 7 Drawing Sheets

(56) References Cited

U.S. PATENT DOCUMENTS 2,390,116 A * 12/1945 Michelman ..... E06B 9/15 160/133
2,495,963 A 3/1946 Greegor
2,545,400 A * 3/1951 White ..... E04F 10/08 160/133
2,812,813 A 11/1957 Zarnowski
2,858,883 A 11/1958 Rapin
3,292,685 A 12/1966 Clark
3,431,964 A 3/1969 Rogers
3,489,200 A 1/1970 Recchione
3,670,797 A 6/1972 Sassano
4,037,639 A 7/1977 Jones
4,294,302 A 10/1981 Ricke, Sr.
4,332,287 A 6/1982 Stolpe
4,343,340 A 8/1982 Paule
4,345,635 A 8/1982 Soloman
4,379,479 A 4/1983 Whiting
4,386,645 A 6/1983 Dever et al.
4,428,218 A 1/1984 LaRocca
4,519,434 A 5/1985 Forquer
4,611,848 A 9/1986 Romano
4,628,982 A 12/1986 LaBelle
4,660,613 A * 4/1987 Dagenais ..... E05D 15/26 160/183
4,690,193 A 9/1987 Morrison et al.
4,718,472 A 1/1988 Hormann
4,723,588 A * 2/1988 Ruppel ..... E06B 9/165 160/235
4,738,296 A 4/1988 Hatch
4,795,206 A 1/1989 Adams
4,807,687 A 2/1989 Finch et al.
4,929,862 A 5/1990 Hamilton et al.
4,930,563 A 6/1990 Finch et al.
5,070,925 A 12/1991 Paule
5,154,468 A 10/1992 Teigen et al.
5,165,746 A 11/1992 Teigen
5,204,147 A 4/1993 Schneider
5,205,336 A * 4/1993 Munekata ..... B63B 19/21 160/133
5,209,281 A 5/1993 Kraeutler
5,210,924 A * 5/1993 Schneider ..... E06B 9/15 160/235
5,220,951 A * 6/1993 Dagenais ..... E05D 1/04 160/199
5,253,694 A 10/1993 Bernardo
5,265,663 A * 11/1993 Munekata ..... E06B 9/15 160/133
5,343,924 A 9/1994 Hoffman
5,365,990 A 11/1994 Ueda
5,372,175 A 12/1994 Calhoun et al.
5,377,738 A 1/1995 Cooper
5,426,893 A 6/1995 Hoffman
5,469,905 A 11/1995 McKinney et al.
5,482,104 A 1/1996 Lichy
5,566,739 A * 10/1996 Hoffman ..... E05D 1/04 160/183
5,575,322 A 11/1996 Miller
5,586,592 A 12/1996 McGregor
5,601,130 A 2/1997 Werner et al.
5,611,383 A 3/1997 Hoffman
5,613,539 A 3/1997 Kraler
5,657,805 A 8/1997 Magro
5,682,937 A 11/1997 Decrane et al.
5,839,493 A 11/1998 Quasius
5,850,862 A 12/1998 Miller
5,996,669 A 12/1999 Miller
6,085,822 A 7/2000 Miller
6,095,225 A 8/2000 Miller
6,422,289 B1 7/2002 Miller
6,631,749 B1 10/2003 Zabala
7,121,316 B2 * 10/2006 Biggers ..... E06B 9/0638 160/183
7,357,171 B2 * 4/2008 Miller ..... E06B 9/15 160/133
7,409,980 B1 * 8/2008 Heissenberg ..... E06B 9/08 160/133
D601,716 S 10/2009 Konrad et al.
7,784,522 B2 * 8/2010 Miller ..... E06B 9/15 160/133
8,579,008 B2 * 11/2013 Svenson ..... E05D 1/04 16/225
2005/0205223 A1 * 9/2005 Miller ..... E06B 9/15 160/236
2007/0006980 A1 * 1/2007 Zabala ..... E06B 9/581 160/133
2007/0137802 A1 * 6/2007 Lukasik ..... E06B 9/15 160/235
2008/0202700 A1 8/2008 Miller
2009/0266497 A1 * 10/2009 Motosko ..... E06B 9/15 160/133
2011/0162807 A1 7/2011 Miller
2014/0053991 A1 2/2014 Miller et al.

* cited by examiner

SHUTTER SLAT

This application is a continuation-in-part of U.S. patent application Ser. No. 13/772,154 filed on Feb. 20, 2013, and entitled "Shutter Slat", which claims the benefit of U.S. Provisional Patent Application No. 61/600,909, filed on Feb. 20, 2012, both of which are incorporated by reference herein in their entirety.

BACKGROUND OF THE INVENTION

The present invention relates to shutter slats and in particular to shutter slats of the roller type having improved resistance to storms and break-ins. It furthermore relates to shutter slats having compact refraction capability.

DESCRIPTION OF THE RELATED ART

Conventional roller shutters are designed to provide security from break-ins or protection from storms. Because such protection and security may not always be necessary or desired, such as during the day when a retail store is open for business or during fine weather when a homeowner wishes to open windows or enjoy an ocean view, roller shutters are designed to be retractable into a casing in which they are stored. In some examples, to facilitate compact storage, the rigid shutter slats that are designed to resist hurricane winds and burglars also must be capable of conforming to a roll.

One conventional shutter slat is made to conform to a roll by providing a loose articulation between slats. Slats are slidably engaged at the upper edge of one slat and the lower edge of another slat. The upper edge comprises a vertical projection terminating in a hook-shaped profile. The lower edge comprises a first portion and a second portion that cooperate to define a vertical pocket. The hook-shaped profile of the upper edge allows the upper edge to engage the first portion of the lower edge, also having a hook-shaped profile. The upper edge is prevented from undesirably disengaging the lower edge by the second portion of the lower edge, which comprises a guard extending downward to slightly below the hook-shaped profile of the lower edge, defining a horizontal aperture between the first and second portions of the lower edge. The vertical pocket defined by the first and second portions of the lower edge is similar in depth to the height of the vertical projection of the upper edge. This shutter configuration's flexibility arises from the pivoting of the vertical portion of the upper edge within the horizontal aperture.

One result of this configuration is that the upper edge has significant vertical clearance within the vertical pocket. Shutters according to this configuration are known to have a clearance up to one-quarter inch per slat, or even more. A shutter having 48 slats and one-quarter inch clearance per slat would then have a total clearance of twelve inches between the fully open and fully closed positions. To raise such a shutter having a torsion spring as a counterbalance, a user must lift the bottom slat either by hand or mechanically to correct for the full amount of clearance before the shutter will begin to retract. In such a shutter, a user would have to lift approximately 150 pounds by twelve inches in order to engage the shutter's retraction mechanism. Shutters of this configuration do not obtain full benefit of the counterbalance, as provided by the torsion spring or by other means.

A further result of this configuration is that the loosely articulated slats are known to be noisy. The slats rattle against each other during extension and retraction. In addition, when the roller shutter is deployed, the normal forces of the wind are sufficient to cause the slats to rattle audibly.

Conventional shutter slats are generally designed to hang from a roll or spindle, the roll or spindle contained in a casing. When the shutter is retracted, the slats wrap around the spindle. Because the slats do not fit together compactly around the roll, the resulting shutter assembly, when retracted, creates a roll with a large diameter, and therefore requires a large casing for the roll. This can be unsightly, especially in shutter applications used on residential buildings. Thus, a shutter assembly that is capable of compact storage is desirable.

One solution to the problem of compact storage includes integration of a boss concentric with the articulation between adjoining slats, as described in U.S. Pat. No. 6,095,225 to Miller, titled "Shutter Slat with Integrated Boss." The slats in this configuration are also slidably engaged at the upper edge of one slat and the lower edge of another slat. The upper edge comprises a short vertical projection terminating in a c-shaped screw boss, and the lower edge comprises a c-shaped channel having a diameter sufficient to accommodate the upper edge. The flexibility of this shutter configuration arises from the cooperation of the rounded internal surface of the c-shaped channel and the rounded external surface of the c-shaped screw boss. The diameter of the upper edge is smaller than the diameter of the c-shaped channel, but greater than the width of the aperture defined by the c-shaped channel, preventing the upper edge from simply falling out of the c-shaped channel provided by the lower edge.

One result of this configuration is that if the exposed portion of the c-shaped channel of the lower edge gives way upon exertion of pressure on the articulation, the slats may separate undesirably. Because the retention of the upper edge by the c-shaped channel is based on a relatively small difference in size, damage to either edge may result in a breach of the rolling shutter. For example, if a putative intruder hits the shutter, the c-shaped channel may be forced open. Even if the channel is bent only slightly, once a gap is formed between an upper edge and a lower edge, the two slats may be pried apart with undesirably slight effort.

There is a need for shutter slats that completely minimize the space required for a rolling shutter made up of the slats to be wound up in a fully closed configuration. There is also a need for shutter slats that do not retain water, which can freeze and damage the slats.

SUMMARY OF THE INVENTION

The invention is a rolling shutter slat for use in a rolling shutter, said slat having a first end, a second end and a profile comprising a body having an upper edge and a lower edge, an outward facing side extending between the upper edge and the lower edge, and an inward facing side extending between the upper edge and the lower edge. The slat has engaging track connected to the body at the upper edge, the engaging track having a hook that extends upward from the upper edge at a smoothly curved transition between the engaging track and the upper edge. The slat further comprises a receiving track connected to the body at the lower edge, comprising a lip member having an outer lip surface and an articulating lip surface, the outer lip surface being contiguous with the inward facing side of the body and extending downward along the same curve as the inward facing side of the body to a curl, the curl extending upward to a tip. The receiving track further comprises a guard member spaced apart from the lip member, an articulation space wherein a second engaging track of a second identical slat may hook the lip member through an aperture between the lip member and the guard member to form a hinge, and a receptacle located between the lip member and the guard member that is separated from the articulation space by a first shoulder on the articulating lip surface and a second shoulder on the articulating guard surface, wherein the lowest point of the curl is horizontally displaced from the intersection of the second engaging track and a body of the second identical slat.

In another embodiment, the shutter slat comprises a body having a curvature with a convex side and a concave side, a first end and a second end. A hooking track is positioned at the first end, with a bend formed between the body and the hooking track, the hooking track projecting above the convex side of the body. A receiving track is positioned at the second end, the receiving track including a guard member extending along the curvature of the body, and a lip member projecting below the concave side of the body. An articulation space is defined between the lip member and guard member, the articulation space sized and shaped to hingedly engage the hooking track. In a further alternative embodiment, the shutter slat may be incorporated in a rolling shutter where a plurality of slats form a chain extending from a spindle, the hooking track of each successive slat engaged in the receiving track of the preceding slat in the chain.

BRIEF DESCRIPTION OF THE FIGURES

Embodiments of the invention will now be explained in further detail by way of example only with reference to the accompanying figures, in which.

DETAILED DESCRIPTION OF THE INVENTION

Figure 1:
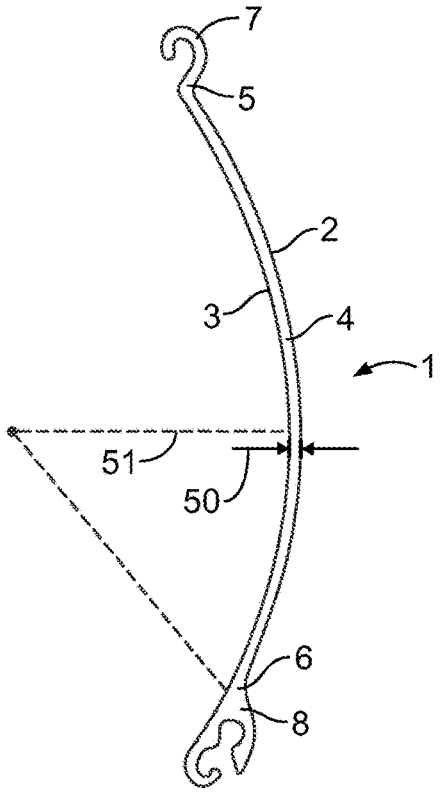
FIG. 1 is a side view of a shutter slat according to the present invention.
Figure 2:
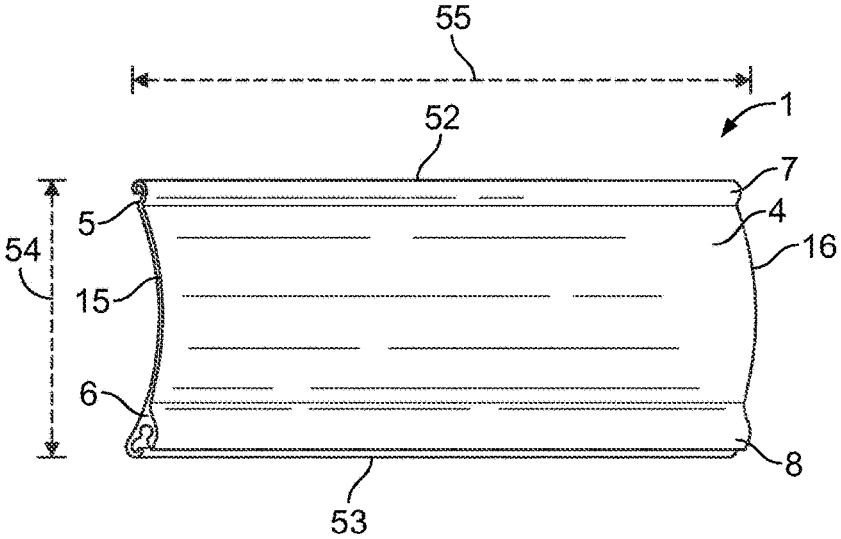
FIG. 2 is an elevation of a shutter slat according to the present invention.

FIGS. 1 and 2 show a shutter slat 1 according to the present invention. Illustratively, shutter slat 1 is an elongated body of extruded aluminum having a body portion 4, a hooking track 7, and a receiving track 8. The body portion 4 is bound by an outward facing side 2, an inward facing side 3, a first edge 5, a second edge 6, a first end 15 and a second end 16. In this embodiment, the slat is formed of a single ply of extruded aluminum; however, double-ply aluminum, as well as other metal or plastic materials is also contemplated.

FIG. 1 is a side view of a shutter slat 1 according to the present invention. The body portion 4 is a curved single-wall having an outward facing side 2, an inward facing side 3, a first edge 5, and a second edge 6. The outward facing side 2 of body portion 4 has a convex cross-section and the inward facing side 3 has a concave cross-section when sectioned vertically at any location along the length of slat 1. The distance between outward facing side 2 and inward facing side 3 defines the thickness 50 of body portion 4.

Figure 5:
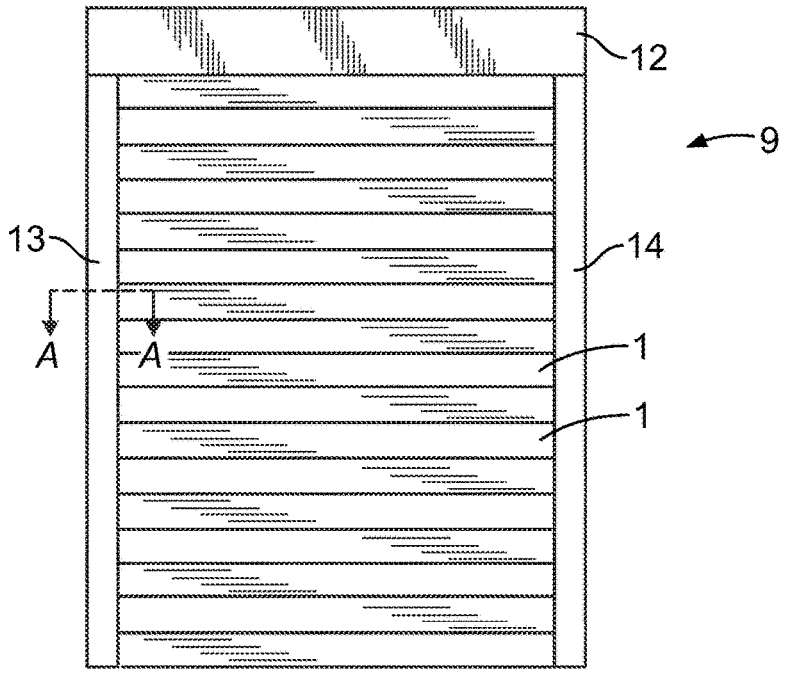
FIG. 5 is an elevation of a window aperture including a rolling shutter according to the present invention.

FIG. 2 is an elevation of a low-clearance shutter slat 1 according to the present invention. The distance between the upper end 52 of hooking track 7 and the lower end 53 of receiving track 8 defines the vertical height 54 of slat 1. However, each slat 1 in a rolling shutter 9 may not have the same vertical height 54. Those skilled in the art will recognize that the vertical height 54 of slat 1 is not critical so long as the slat 1 is conformed to roll into a shutter casing 12 (FIG. 5). It may be advantageous to vary the vertical heights 54 of slats 1 in a rolling shutter 9 to minimize the space required to retract the rolling shutter 9 into a fully closed position.

The distance between first end 15 and second end 16 of body portion 4 defines the overall horizontal width 55 of slat 1. The overall horizontal width 55 must be wide enough to cover a building aperture or other opening in which a rolling shutter 9 made with slats 1 is designed to protect.

Figure 9:
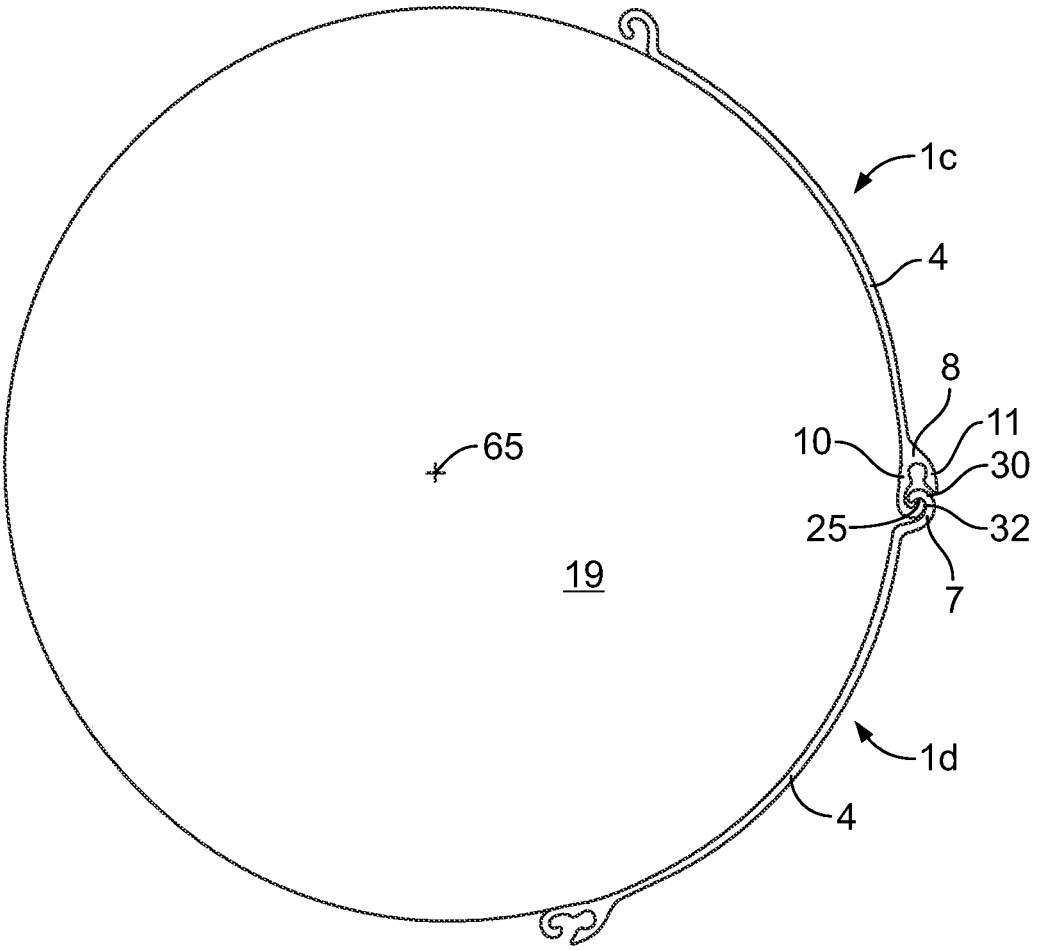
FIG. 9 is a side view of the cooperation of two shutter slats according to the present invention when the shutter slats are in a closed position.

Outward facing side 2 and inward facing side 3 are both formed with a radius of curvature 51. However, those skilled in the art will recognize that radius of curvature 51 is not critical so long as slat 1 is conformed to wrap around a spindle 19 (FIG. 9). The overall vertical height 54 and the radius of curvature 51 of body portion 4 cooperate to allow a rolling shutter 9 formed by slats 1 to roll when retracted around a spindle 19. The radius of curvature 51 of body portion 4, the overall vertical height 54, and the thickness 50 are selected to facilitate retraction and winding of a rolling shutter 9 formed from slats 1 around the spindle 19 and to provide strength to the rolling shutter 9.

Figure 3:
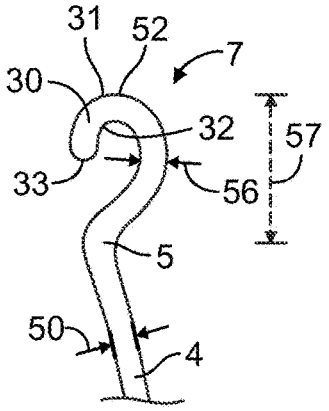
FIG. 3 is a detailed view of a hooking track according to the present invention.

FIG. 3 is a detailed view of hooking track 7, which is connected to body portion 4 at first edge 5, which is a smooth concave transition. Hooking track 7 includes a hook 30 with an outer surface 31, an inner surface 32, and a tip 33. Hooking track 7 is formed integrally with body portion 4. However, it is understood that hooking track 7 could be formed separately and fixed to body portion 4. It is also understood that hooking track 7 could, in the alternative, be located at second edge 6.

Hook 30 of hooking track 7 has a profile that is dimensioned to be substantially similar to the profile of articulation space 20 of receiving track 8. Hook 30 may have a single radius, or the radius may change along the profile of hook 30. In the embodiment shown, the radius of hook 30 decreases closer to tip 33.

Outer surface 31 has a radius of curvature that in conjunction with the radius of curvature of inner surface 32 causes hooking track 7 to have a substantially uniform thickness 56 from tip 33 to first end 5 of body portion 4. The thickness 56 of hooking track 7 in this embodiment is substantially similar to the thickness 50 of body portion 4. Hooking track 7 also has a vertical height 57 that extends from first edge 5 to upper end 52.

Figure 4:
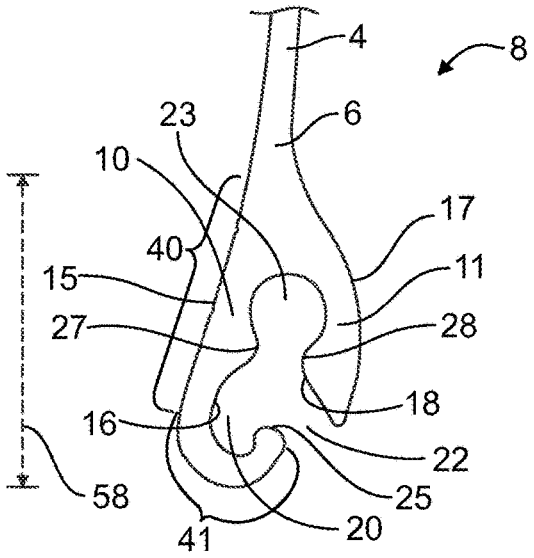
FIG. 4 is a detailed view of a receiving track according to the present invention.

FIG. 4 is a detailed view of receiving track 8, which is connected to body portion 4 at second edge 6. Receiving track 8 includes a lip member 10, a guard member 11, and an articulation space 20. Receiving track 8 may also include a receptacle 23. Receiving track 8 is formed integrally with body portion 4. However, it is understood that receiving track 8 could be formed separately and fixed to body portion 4.

Receiving track 8 has a vertical height 58 that extends from second edge 6 to lower end 53. However, those skilled in the art will recognize that the vertical height 58 of receiving track 8 is not critical so long as receiving track 8 is dimensioned to engage hooking track 7.

Lip member 10 has an outer lip surface 15, an articulating lip surface 16, and a tip 25. Outer lip surface 15 further includes an outer lip wall 40 and an outer lip curl 41. Outer lip wall 40 of outer lip surface 15 is contiguous with the inward facing side 3 of body portion 4 such that the curvatures 51 of inward facing side 3 and outer lip wall 40 are the same, and there is no break between inward facing side 3 and outer lip wall 40. This common curvature 51 minimizes the space taken up by slat 1 when a rolling shutter 9 made of slats 1 is retracted into a fully closed position.

Guard member 11 has an outer guard surface 17 and an articulating guard surface 18. As shown, articulating surfaces 16 and 18 may be wholly or partially concave. Such concave articulating surfaces allow for improved articulation between adjacent slats without the need to provide additional vertical clearance.

Articulation space 20 is the space within which a hooking track 7 of an adjacent slat 1 is received in receiving track 8 to form a rolling shutter 9. The tip 25 of lip member 10 and the articulating guard surface 18 of guard member 11 define an aperture 22 communicating with articulation space 20. Hook 30 of hooking track 7 of the adjacent slat 1 is dimensioned to enter articulation space 20 through aperture 22. The profile of articulation space 20 is dimensioned to substantially match the profile of hook 30 of hooking track 7. Tip 33 of hook 30 of the adjacent slat 1 seats against articulating lip surface 16 of lip member 10, thereby forming a hinge between hooking member 7 of the adjacent slat 1 and receptacle member 8. Outer surface 31 of hook 30 of the adjacent slat 1 contacts articulating guard surface 18 of guard member 11, thereby preventing hooking member 7 of the adjacent slat 1 from disengaging with receptacle member 8.

In prior art designs, receiving tracks have thin guard members that are substantially vertical when the slat is in a vertical position. The lowest point of such a prior art guard member extends below the lowest point of the communicating lip member. Guard member 11 is considerably shorter than the guard members of prior art slats, and the lowest point of guard member 11 terminates above the lowest point of lip member 10 when slat 1 is in a vertical position. Because guard member 11 is shorter in relation to the lip member, it is thickened and reinforced at the point where it engages the hooking track 7 of the adjacent slat 1 without appreciably increasing the amount of extruded aluminum required to form receiving track 8, further increasing the security of the hinge formed by two slats without requiring additional material expense. The increased thickness of guard member 11 also protects slat 1 from excessive articulation that may disengage the hinge formed with the hooking track of another slat 1.

Figure 6:
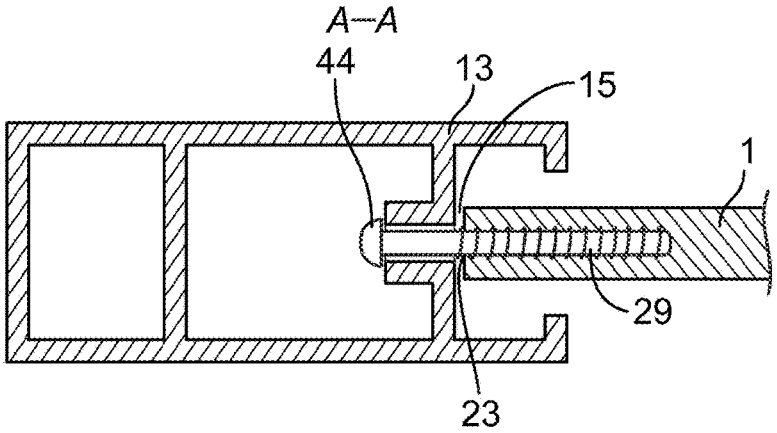
FIG. 6 is a partial horizontal sectional view of a shutter slat according to the present invention engaged in a track, taken along lines A-A.

Receptacle 23 is adapted to receive a retention or alignment device 29 (FIG. 6). This retention or alignment device may be a screw, bolt, or other device capable of being retained by the receptacle and capable of aligning slats with one another and/or retaining the slat to a guide. Articulating lip surface 16 has a shoulder 27 which separates articulation space 20 from receptacle 23, and articulating guard surface 18 has a shoulder 28 which separates articulation space 20 from receptacle 23. When slat 1 is in a vertical position, as shown in FIG. 1, receptacle 23 is located above shoulders 27 and 28. As shown in FIG. 4, it is advantageous to locate receptacle 23 between the body portion 4 and aperture 22. It is understood that if receiving track 8 were located at first edge 5 of slat 1, receptacle 23 still would be located between body portion 4 and aperture 22.

While receptacle 23 is a space distinct from articulation space 20 and separated by shoulders 27 and 28, as shown, receptacle 23 has a portion that is open to and in communication with articulation space 20. The hooking track 7 of an adjacent slat 1 cannot enter the gap between first shoulder 27 and second shoulder 28 and cannot be retained in receptacle 23. Although receptacle 23 is in open communication with articulation space 20, receptacle 23 is protected from the collection of dirt and grime by lip member 10 and guard member 11, and by the hooking track 7 of an adjacent slat 1. If desired, it is understood that receptacle 23 may be completely separated from articulation space 20. In such an embodiment, articulating surfaces 16 and 18 would be connected at shoulders 27 and 28 to provide a single, continuous articulating surface for the hooking track 7 of a second slat 1.

FIG. 5 shows an elevation of a plurality of shutter slats 1 according to the present invention, articulated into a rolling shutter 9 which may be installed on a building aperture such as a window or door. Details of the building aperture are not illustrated for the sake of clarity. The building aperture is further equipped with shutter casing 12 and a pair of guides 13 and 14, located on opposite lateral edges of the building aperture. Rolling shutter 9 may be rolled up for storage within shutter casing 12. The first and second ends 15 and 16 of slat 1, as shown in FIG. 2, are adjacent guides 13 and 14. Retention screw 29 provides for secure alignment of ends 15 and 16 with guides 13 and 14.

FIG. 6 is a partial sectional view taken along lines A-A of FIG. 5. A shutter slat 1 is shown in combination with a guide 13 and a retention screw 29. Retention screw 29 is preferably inserted in receptacle 23 of shutter slat 1 for use with guide 13. The head 44 of the retention screw 29 protrudes from receptacle 23 and slides within vertical guide 13 provided at the end of rolling shutter 9. In this illustrative embodiment, retention screw 29 does not restrict the rotation or pivoting of hooking track 7 within receiving track 8. As illustrated, for minimization of the rolling shutter, the diameter of the head 44 of retention screw 29 is not larger than the external profile of receiving track 8. Because of the space between head 44 of screw 29 and first end 15 of slat 1, the receiving track 8 of one slat 1 may slide horizontally with respect to the hooking track 7 of another slat 1. The amount of horizontal sliding may be limited in part by the space between head 44 of screw 29 and first end 15 of slat 1 or by the configuration of guides 13 and 14. An extended screw (not shown) with an extension member may be used in place of screw 29. The extension member of an extended screw is longer than head 44 of screw 29 and is better adapted to retain rolling shutter 9 within guides 13 and 14 during either an attempted break in or extreme wind conditions. An example of an extended screw is disclosed in U.S. Pat. No. 7,784,522.

Figure 7:
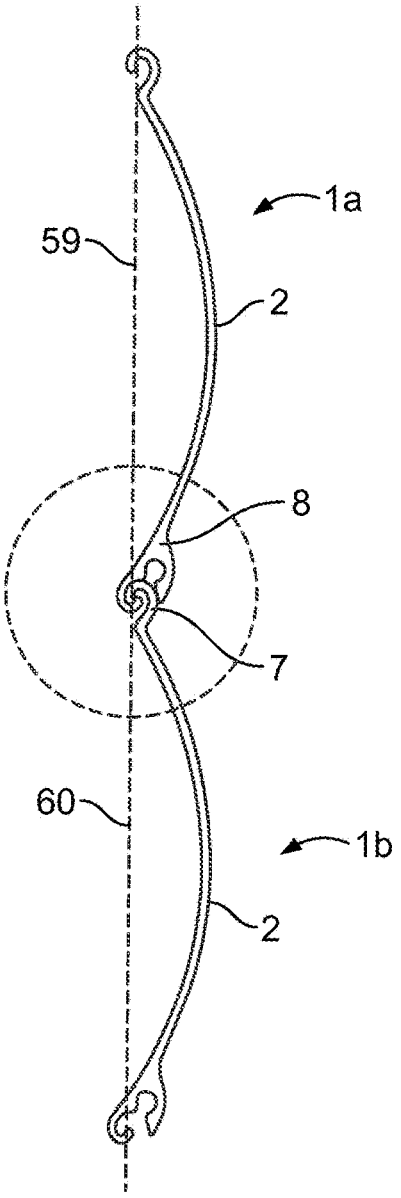
FIG. 7 is a side view of the cooperation of two shutter slats according to the present invention when the shutter slats are in an open position.
Figure 8:
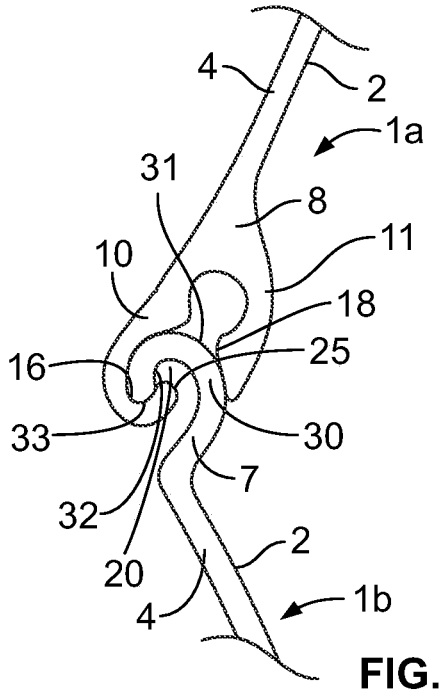
FIG. 8 is a detailed view of the cooperation between the hooking track and receiving track of the two shutter slats of FIG. 7.

FIG. 7 is a side view showing the cooperation of two slats 1*a* and 1*b* according to the present invention, and FIG. 8 is a detailed view of the cooperation of receiving track 8 of slat 1*a* and hooking track 7 of slat 1*b*. Both FIG. 7 and FIG. 8 show slats 1*a* and 1*b* engaging when the shutter slats are in an open position. As shown in FIG. 7, the bottom slat 1*b* is in a vertical position, i.e. the position as in an open shutter, with the vertical axis 59 of slat 1*a* substantially or completely in line with vertical axis 60 of slat 1*b*. There is very little clearance space provided between slats. Still, bottom slat 1*b* can articulate in a clockwise direction.

As shown in FIG. 8, hooking track 7 of slat 1*b* is slidably engaged with receiving track 8 of slat 1*a* to form a hinge between slats 1*a* and 1*b*. The outer surface 31 of hook 30 of slat 1*b* is convex and seats against the articulating lip surface 16 of lip member 10 and the articulating guard surface 18 of guard member 11 of slat 1*a*. Tip 33 of hook 30 of slat 1*b* also seats against articulating lip surface 16 of lip member 10 of slat 1*a*. Lip member 10 of slat 1*a* retains hook 30 of slat 1*b* in articulation space 20. Tip 25 of lip member 10 of slat 1*a* extends into a space defined by hook 30 of slat 1*b*. Tip 25 of lip member 10 of slat 1*a* also curls into articulation space 20, providing additional security to the hinge formed by hooking track 7 of slat 1*b* and receiving track 8 of slat 1*a*.

Guard member 11 shields the connection of hooking track 7 of slat 1*b* with lip member 10 of slat 1*a*, preventing hooking track 7 of slat 1*b* from disengaging from receiving track 8 of slat 1*a*. Guard member 11 also protects hooking track 7 of slat 1*b* and lip member 10 of slat 1*a* from exposure to forces applied to the outward facing sides 2 of slats 1*a* and *b*. In the open position, the weight bearing portion of receiving track 8 is lip member 10. Because hooking track 7 of slat 1*b* does not bear directly upon guard member 11 of slat 1*a*, damage to the outward facing side 2 of slat 1*a*, and to guard member 11 of slat 1*a*, is less likely to disengage the articulation between slats 1*a* and 2*b* than in prior art shutters in which an exposed portion of the lower track was weight bearing.

One advantage to the design of lip member 10 and guard member 11 is that slats 1*a* and 1*b* do not retain water in the hinge formed by hooking track 7 of slat 1*b* and receiving track 8 of slat 1*a*. Lip member 10 of slat 1*a*, at its lowest point, is horizontally displaced from the intersection of body portion 4 and hooking track 7 of slat 1*b*. The intersection of body portion 4 and hooking track 7 of slat 1*b* is a smooth transition. This design allows water to flow cleanly from lip member 10 of slat 1*a* without draining into the hinge formed by the intersection of slats 1*a* and 1*b*.

Slat 1 does not require a protrusion to prevent excessive articulation. With slat 1, guard member 11 is thickened in comparison to prior art slats. The thickness of guard member 11 and the shape of lip member 10 prevent slat 1 from excessive articulation, and there is no need for a protrusion on hooking member 7. Without a protrusion, there is no channel to retain water that drips off lip member 10. If water were to be retained, it could freeze and damage the hinge.

FIG. 9 is a side view showing the cooperation of two slats 1*c* and 1*d* engaging when the slats are in a closed position. As shown, tip 25 of lip member 10 of slat 1*c* lies flush against inner surface 32 of hook 30 of slat 1*d*, and body portions 4 of slats 1*c* and 1*d* form a substantially circular arc when the slats are in a fully closed position. This arc allows an initial subassembly of slats 1 of a rolling shutter 9 to lie substantially flush against spindle 19 when the slats are in a fully closed position, and allows subsequent subassemblies of slats 1 to form similar arcs around the initial subassembly and around other subassemblies. Those skilled in the art will understand that it may be advantageous to alter the arcs of the slats as the distance between the slats and the spindle increases to minimize the overall space needed for the rolling shutter 9 in its fully closed position.

The shape of guard member 11 further minimizes the overall radius of a rolling shutter 9 of slats 1 when the shutter is in a closed position. As set out above, guard member 11 is shorter and thicker than prior art slats, and the lowest point of guard member 11 is above the lowest point of lip member 10 when slat 1 is in a vertical position. As shown in FIG. 9, when slats 1*c* and 1*d* are in a closed position, guard member 11 of slat 1*c*, at its furthest point from the center 65 of spindle 19, is located approximately the same distance from the center 65 of spindle 19 as hooking track 7 of slat 1*d* at its furthest point from the center 65 of spindle 19. This configuration minimizes the overall radius of a rolling shutter 9 of slats 1 when the shutter is in a closed position by minimizing the overall radius taken up by each subassembly of slats circling spindle 19. The outer surface of guard 11, furthermore, is formed to be substantially parallel to the curvature of the body, thereby reducing the overall radius of the rolled up shutter slat.

In a preferred embodiment, the slat is provided with a bend or indent between the hooking track and the body of the slat. As best shown in FIG. 3, slat 1 has a bend between the body 4 and hooking track 7, at the first edge 5. The bend allows the hinge between adjacent slats to form a smooth transition. For example, FIGS. 7 and 8 show a hinge between the slats 1*a* and 1*b* in the vertical position. When the hooking track 7 of a slat 1*b* is engaged in the receiving track 8 of a slat 1*a*, the bend permits a smooth transition to be formed between the outer surface 31 of hook 30 and the outer guard surface 17 of the guard member 11. This smooth transition is believed to allow water to flow cleanly over the hinge, without collecting and draining into the hinge. It has further been found that the more acute the angle of the bend, the more effective in reducing the infiltration of water into the hinge.

Figure 10:
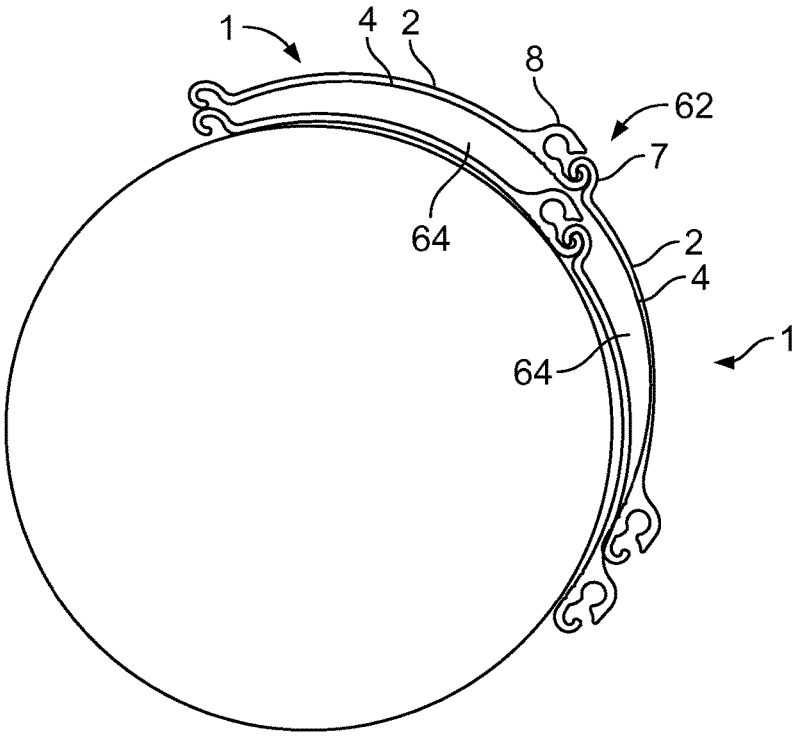
FIG. 10 is a side view of the shutter slats of FIG. 9, showing the interaction between successive windings of shutter slats.

In some slat configurations, the presence of a bend between the body and hooking track can interfere with the ability to minimize the space required to retract the rolling shutter into a fully closed position. For example, FIG. 10 shows slats 1 with a hooking track 7 and a receiving track 8 that project above the convex curvature of the body 4 of the slat—i.e. projects from the outward facing side 2. The engagement of the hooking track 7 and receiving track 8 forms a hinge 62 that projects above the common convex curvature of the slats 1, and creates gaps 64 between the bodies 4 of adjacent slats in successive windings. These gaps interfere with a compact fit when the shutter is rolled into a retracted or a fully closed position.

Figure 11:
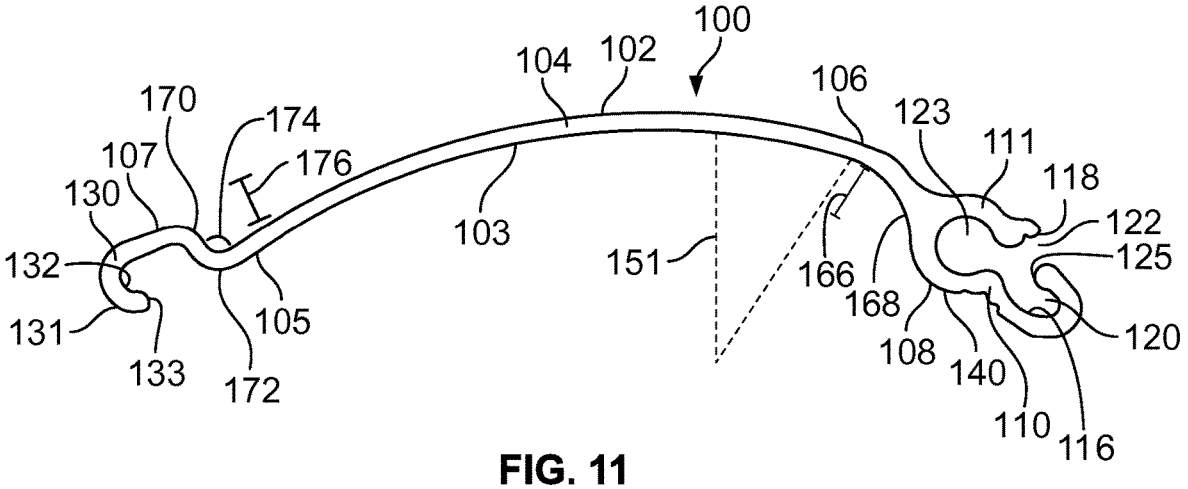
FIG. 11 is a side view of an alternative embodiment of a shutter slat.
Figure 12:
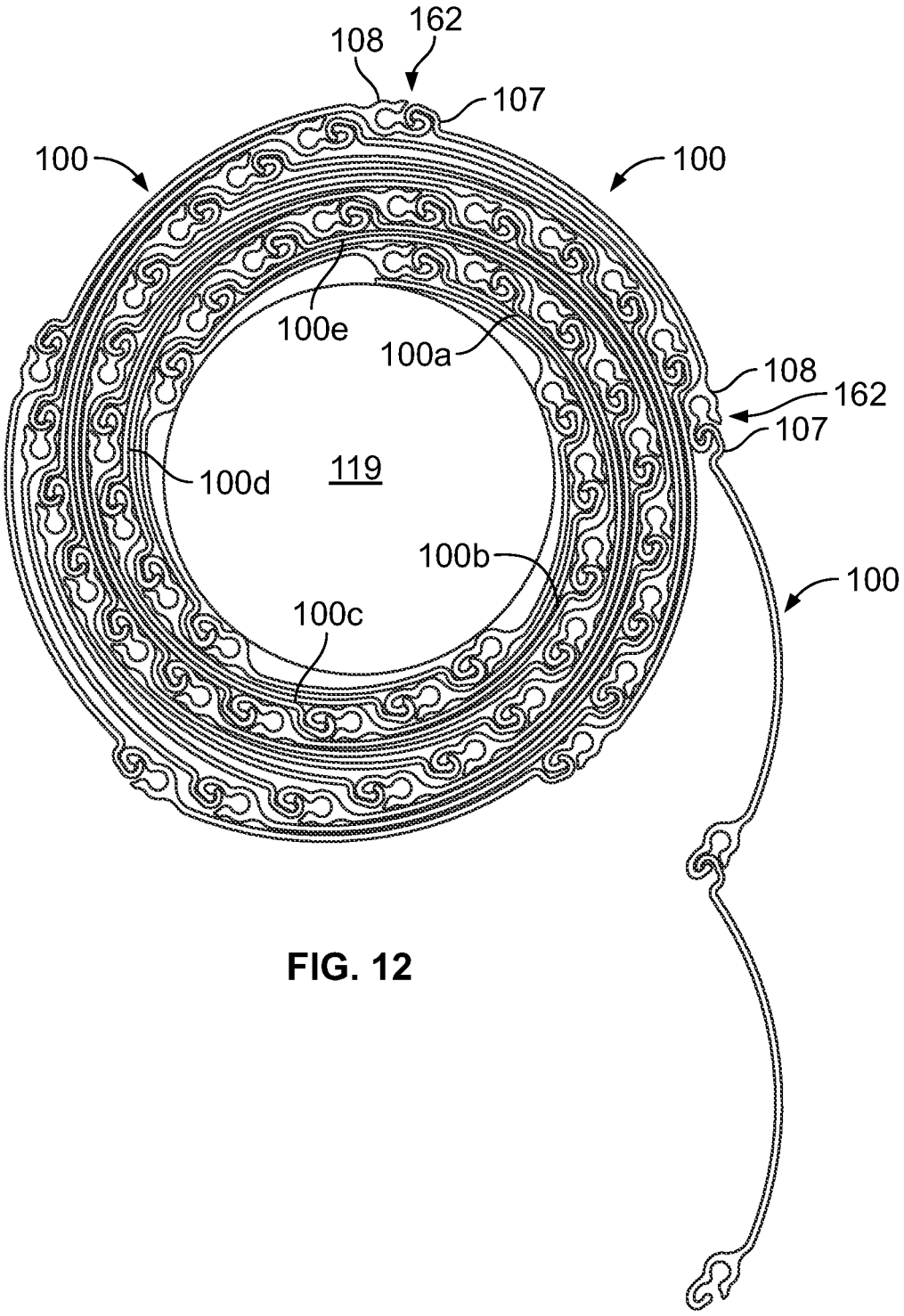
FIG. 12 is a side view of a rolling shutter comprised of shutter slats of FIG. 11 in a refracted position.

It has been found that the space required for the rolling shutter in the refracted position can be minimized without sacrificing the bend between the body and hooking track, by forming the slat with a receiving track that projects below the concave curvature of the body of the slat—i.e. projects from the inward facing side. Referring to FIGS. 11 and 12, an alternative embodiment of a slat is shown having a receiving track with a lip member that projects below the concave curvature of the inward facing side of the body. The guard member of the receiving track extends along the curvature of the body.

As shown in FIG. 11, slat 100 has a body 104 with a first edge 105 and a second edge 106 opposite the first edge. Body 104 has a curvature with a radius of curvature 151, a convex outward facing side 102 and a concave inward facing side 103. A hooking track 107 is connected to the body 104 at the first edge 105, and a receiving track 108 is connected to the body at the second edge 106.

Receiving track 108 includes a lip member 110, a guard member 111, and an articulation space 120. Lip member 110 comprises a base 168 that is adjacent to the end 106 of body 104, and an outer lip wall 140. Lip member 110 projects below the concave inward facing side 103 of body 104 by a height 166. Guard member 111 extends along the curvature of body 104. Articulation space 120 is in communication with an aperture 122 that is defined between lip member 110 and guard member 111. Articulation space 120 is sized and shaped to hingedly engage the hooking track 107. Receiving track 108 may also include a receptacle 123 defined between the lip member 110 and guard member 111, that is sized and shaped to receive a retention or alignment device (not shown) as previously described.

Hooking track 107 comprises a hook 130 with an outer surface 131, an inner surface 132, a base 170 adjacent to end 105 of body 104, and a tip 133. Hook 130 is sized and shaped to be substantially similar to the size and shape of articulation space 120 of receiving track 108. A bend 172 having an interior angle 174 is formed between hooking track 107 and body 104. Bend 172 causes hooking track 107 to project above the convex outward facing side 102 of body 104 by a height 176.

Figure 13:
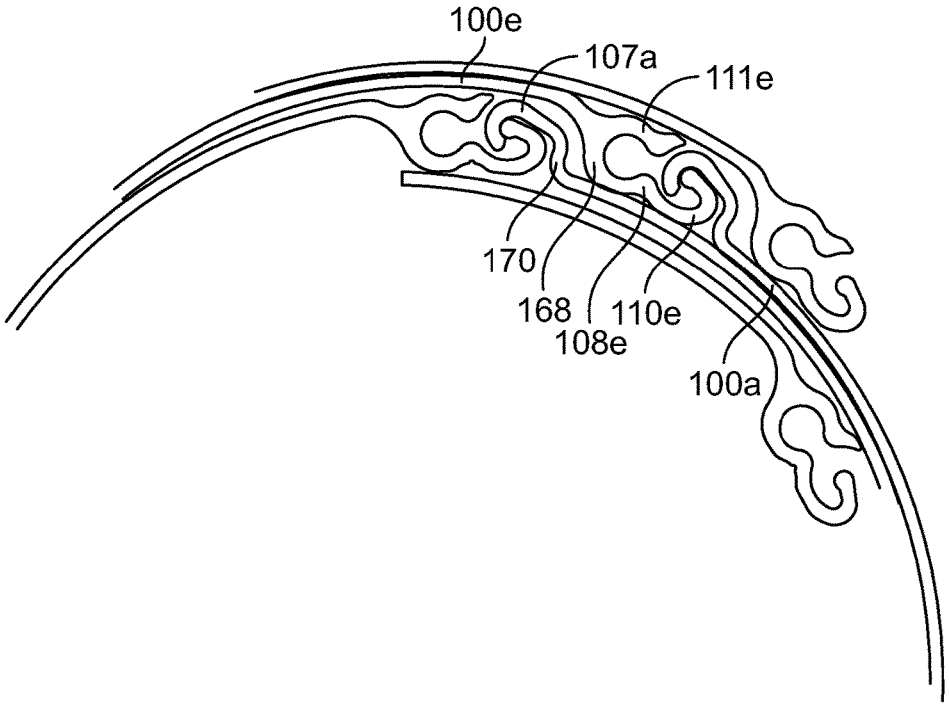
FIG. 13 is a detail side view of the shutter slats of FIG. 12.

FIGS. 12 and 13 show a rolling shutter in a retracted position, that comprises a plurality of slats 100 forming a chain extending from a spindle 119. The hooking track 107 of each successive slat 100 is hingedly engaged in the receiving track 108 of the preceding slat 100 in the chain. In the retracted position, the chain of slats is wound about spindle 119 in a series of windings that are increasingly distal to the spindle.

An example of a single winding is shown by the slats 100*a*, 100*b*, 100*c*, 100*d* and 100*e*—i.e. where slat 100*a* is the initial slat in the winding positioned closest to the spindle, slat 100*e* is the last slat in the winding positioned furthest from the spindle, and slats 100*b*, 100*c* and 100*d* are intermediate slats positioned between the initial and last slats 100*a* and 100*e*. As shown in FIG. 13, the hooking track 107*a* of the initial slat 100*a* is positioned adjacent to the receiving track 108*e* of the last slat 100*e*. In addition, the body 104*e* of the last slat 100*e* overlaps the hooking track 107*a* of the initial slat 100*a*. Conversely, the body 104*a* of the first slat 100*a* underlaps the receiving track 108*e* of the last slat 100*e*. Similarly, the intermediate slats 100*b*, 100*c* and 100*d* have hooking tracks 107 that are positioned adjacent to the receiving tracks 108 and are overlapped by the bodies 104 of the slats in the successive winding, and have bodies 104 that underlap the receiving tracks 108 of the slats in the successive winding.

To minimize the space required in the retracted position, slat 100 may be configured with a receiving track 108 having a lip member 110 that projects below (inward) the concave side 103 of body 104 at a height 166 that is approximately the same as the height 176 that the hooking track 107 projects above (outward) the convex side 102 of the body 104. The guard member 111 of the receiving track 108 has a curvature that extends along the curvature of body 104, and the outer wall 140 of the lip member 110 of receiving track 108 may also have a curvature that is the same or approximately the same as the curvature of body 104. In addition, the base 168 of the receiving track 108 adjacent to the end 106 of body 104 may be sized and shaped to be complementary to the size and shape of the base 170 of the hooking track 107 adjacent to the end 105 of body 104.

As discussed above, the curvature and vertical height of the body 104 may be varied to minimize the space required by the rolling shutter in the retracted position. As is apparent in FIG. 12, the radius and circumference of each successive winding increases the further away from the spindle. Thus the radius 151 of the curvature of slats 100 may increase the further away from the spindle 119—i.e. the radius of curvature of the body 104 of a slat proximal to the spindle may be shorter than the radius of a slat distal to the spindle. Similarly, height of slats 100 may increase the further away from the spindle 119—i.e., the height between ends 105 and 106 of the body 104 of a slat proximal to the spindle may be shorter than the height of a slat distal to the spindle.

In another embodiment, the interior angle 174 of the bend 172 may vary between slats in a rolling shutter. Those of skill in the art will appreciate that, as the radius 151 of the curvature of the body 104 increases, the interior angle 174 of the bend 172 may also increase to accommodate the flatter curvature of the body and minimize any gap between the bodies of adjacent slats in successive windings. Thus, the interior angle 174 of the bend 172 of a slat 100 proximal to the spindle 119 may be smaller than the interior angle of a slat distal to the spindle.

In a further embodiment, each winding of the rolling shutter in the retracted position has the same number of slats. In the embodiment of FIG. 12, each winding comprises 5 slats, where each of the hinges 162 is seated against a preceding hinge to form a compact roll.

In addition to minimizing the space required in a retracted position, these embodiments are believed to provide further advantages. As discussed above, the receiving track 108 may have a guard member 111 with a curvature that is the same or similar to the curvature of body 104, and with a lip member that 110 that projects below the concave inward facing side 103 of the body. This configuration minimizes the profile of the hinge 162 on the convex outward facing side and smooths the transition between engaged shutter slats 100, which allows water to flow more cleanly off the exterior surface of the rolling shutter, and reduces any projecting surfaces where water may collect and drain into the hinge. The minimal profile of the hinge 162 also reduces the exposure of the receiving track 108 and hooking track 107 on the exterior outward facing side 102 of the rolling shutter, which may otherwise provide a weak point to force apart the engaged shutter slats. The engagement of the receiving track 108 and hooking track 107 is moved to the interior side 103 of the rolling shutter, allowing the guard member 111 to more effectively protect the hooking track from forces applied to the outward facing sides 102 of the shutter slats.

Figure 14:
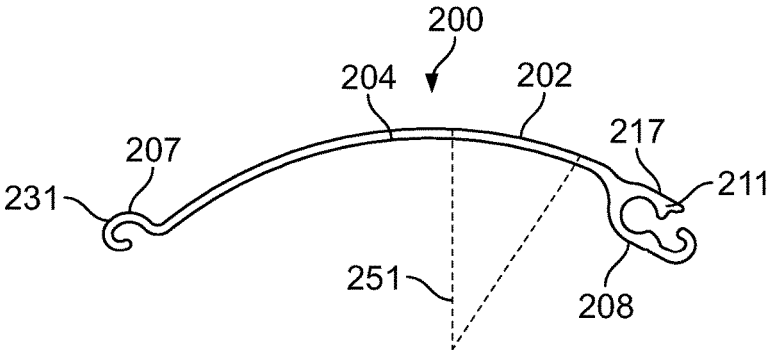
FIG. 14 is a side view of a further alternative embodiment of a shutter slat.
Figure 15:
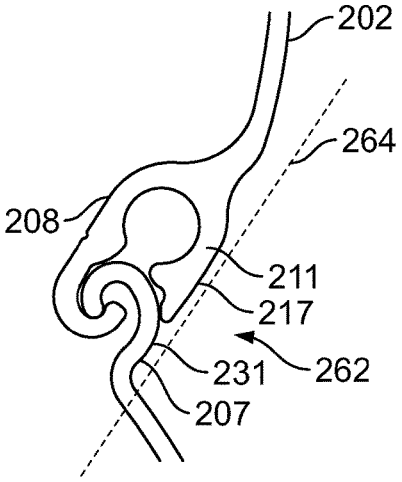
FIG. 15 is a side view of a hinge formed by engagement of two shutter slats of FIG. 14.

In yet another embodiment, the slat may be configured to further minimize the profile of the hinge 262. FIGS. 14 and 15 show a slat 200 with a body 204, a hooking track 207 and a receiving track 208. Body 204 has a convex outward facing surface 202 with a curvature having a radius 251. Receiving track 208 has a guard member 211 with an outer guard surface 217 that generally extends along the curvature of outward facing surface 202 of body 204. Thus, outer guard surface 217 and outward facing surface 202 form a surface with a generally continuous curvature, which further minimizes the profile of the outward facing surface of the hinge 262.

In a preferred embodiment, the hooking track 207 is also sized and shaped to minimize the profile of the outward facing surface of hinge 262. As best shown in FIG. 15, when adjacent slats are in the vertical position, the outer surface 231 of hooking track 207 does not generally project beyond a tangent (plane) 264 to the outer guard surface 217 of the receiving track 208. More preferably, when hooking track 207 is engaged in receiving track 208, the outer surface 231 and outer guard surface 217 form a hinge surface that extends along the curvature of outward facing surface 202. Thus, the hinge surface and outward facing surface 202 form a surface with a generally continuous curvature. Consequently, when adjacent slats are in the vertical position, the junction between the two slats is essentially the intersection between the curvatures 251 of the outward facing sides 202 of the two shutter slats. This configuration is also shown by the adjacent vertical slats in FIG. 12.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the scope of the invention.

Shutter slats with different designs were tested for resistance to water intrusion. Shutter Slat A has a conventional slat design, with a receiving track that projects from the convex outward facing side of the slat. Shutter Slat B has a slat design similar to that shown in FIGS. 11 and 14, as discussed above.

Figure 16:
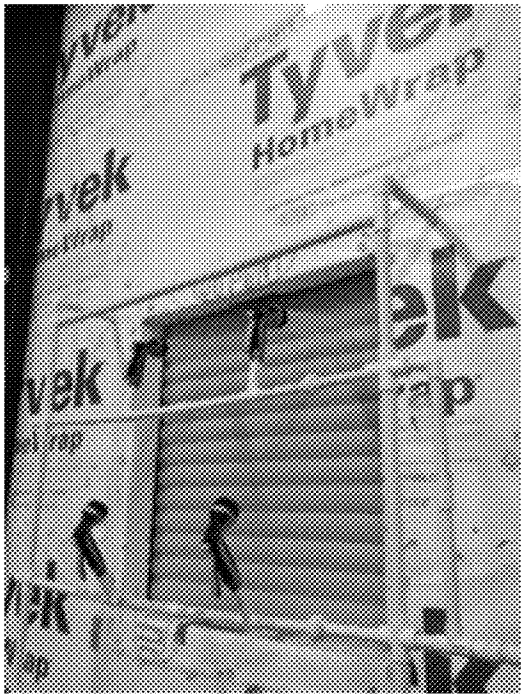
FIG. 16 is a photo of a rolling shutter mounted in an apparatus for testing resistance to water intrusion.

Testing was performed by mounting a shutter in a vertical frame or buck, as shown in FIG. 16. The hinges between adjacent slats of the shutter were compressed by the weight of the shutter. A spray rack was positioned on the exterior side of the shutter, with multiple spray nozzles directed toward the convex outward facing side of the slats. The spray nozzles were centered on the hinges, with a spray angle of 0°, +45° or −45° from horizontal. Water was sprayed against the shutter for a period of 10 minutes, at a flow rate of either 3, 4 or 5 gpm (gallons per minute). A catch trough was positioned on the interior side of the shutter, at the bottom of the shutter to measure the amount of water (ml) that penetrated through the hinge from the exterior side.

TABLE 1

| Water Intrusion Results | | | | | | | | | |
|---|---|---|---|---|---|---|---|---|---|
| | 0° Spray Angle | | | +45° Spray Angle | | | −45° Spray Angle | | |
| | 5 gpm | 4 gpm | 3 gpm | 5 gpm | 4 gpm | 3 gpm | 5 gpm | 4 gpm | 3 gpm |
| Slat A | 20 ml | NM | 0 ml | NM | 0 ml | 0 ml | 0 ml | 0 ml | 0 ml |
| Slat B | 0 ml | 0 ml | 0 ml | 0 ml | 0 ml | 0 ml | 0 ml | 0 ml | 0 ml |

Figure 18:
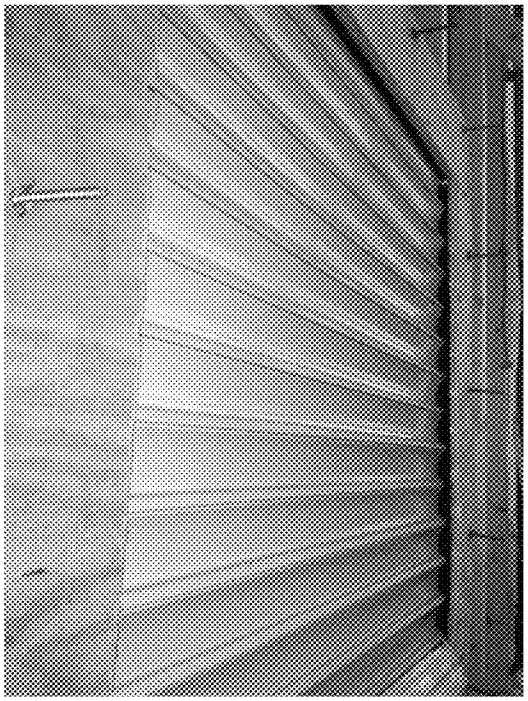
FIG. 18 is a photo of a rolling shutter mounted in the apparatus of FIG. 16 exhibiting no water intrusion during testing.
Figure 17:
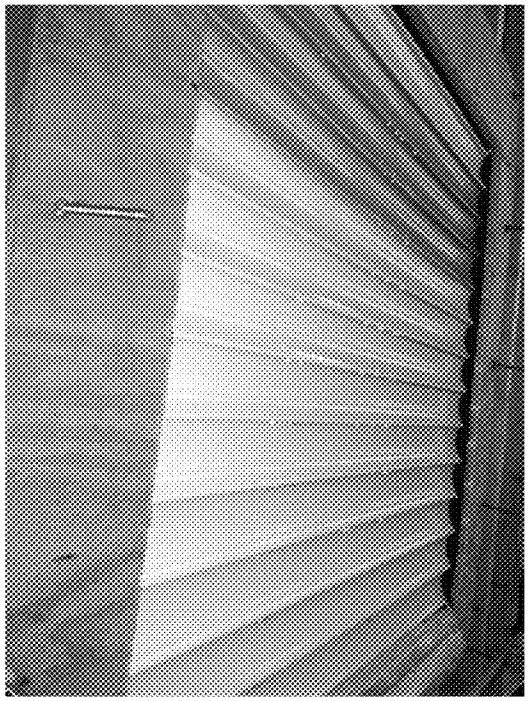
FIG. 17 is a photo of a rolling shutter mounted in the apparatus of FIG. 16 exhibiting water intrusion during testing.

The results of the water intrusion testing is shown in Table 1. Significant amounts of water were found to penetrate the conventional shutter design Slat A at 5 gpm with a 0° spray angle. Immediate, steady drips from multiple hinges were observed, as shown in FIG. 17. Slow drips from a single hinge producing non-measurable (NM) amounts of water were also observed at 4 gpm with a 0° spray angle, and at 5 gpm with a +45° spray angle. In contrast, no water was found to penetrate the shutter design Slat B under any conditions, as shown in FIG. 18.

Modifications in addition to those described above may be made to the structures and techniques described herein without departing from the spirit and scope of the invention. Accordingly, although specific embodiments have been described, these are examples only and are not limiting on the scope of the invention.

What is claimed is:

1. A slat for a rolling shutter, comprising:

a single-walled body having a curvature with a radius of curvature, a convex outward facing side and a concave inward facing side, a first end and a second end;

a hooking track positioned at the first end;

a bend formed between the body and the hooking track, wherein the hooking track projects outward above the convex side of the body and does not extend inward below the concave side of the body;

a receiving track positioned at the second end, the receiving track including a guard member extending along the curvature of the body, and a lip member projecting inward below the concave side of the body; and an articulation space defined between the lip member and guard member, the articulation space sized and shaped to hingedly engage the hooking track.

2. The slat of claim 1, wherein the lip member projects below the concave side of the body at a first height, and the hooking track projects above the convex side of the body at a second height that is approximately the same as the first height.

3. The slat of claim 1, wherein the hooking track includes a first base adjacent to the body and the lip member has a second base adjacent to the body, and wherein the first and second bases are sized and shaped to be complementary.

4. The slat of claim 1, wherein the convex side of the body has a first surface with a first surface curvature, and the guard member has a second surface that extends along the first surface curvature.

5. The slat of claim 1, wherein the lip member has a curvature that is approximately the same as the curvature of the body.

6. A rolling shutter, comprising:

a spindle;

a plurality of slats, each slat comprising:

a single-walled body having a curvature with a radius of curvature, a convex outward facing side and a concave inward facing side, a first end and a second end;

a hooking track positioned at the first end;

a bend formed between the body and the hooking track;

a receiving track positioned at the second end, the receiving track including a guard member that extends along the curvature of the body, and a lip member projecting inward below the concave side of the body; and an articulation space defined between the lip member and guard member, the articulation space sized and shaped to hingedly engage the hooking track;

wherein the plurality of slats form a chain extending from the spindle, the hooking track of each successive slat engaged in the receiving track of the preceding slat in the chain; and wherein the rolling shutter has a retracted position with the plurality of slats wound about the spindle in a first winding and a second successive winding, and the hooking track of each slat in the first winding is overlapped by the body of a slat in the second successive winding and is adjacent to the receiving track of the slat in the second successive winding.

7. The rolling shutter of claim 6, wherein each slat has a respective height between the first and second ends of the body, and wherein the rolling shutter has a retracted position in which the plurality of slats are wound about the spindle with at least one slat proximal and one slat distal to the spindle, and the height of the proximal slat is shorter than the height of the distal slat.

8. The rolling shutter of claim 7, wherein the respective heights of the slats increases as the slats get further away from the spindle.

9. The rolling shutter of claim 7, wherein the radius of curvature of the body of the proximal slat is shorter than the radius of the distal slat.

10. The rolling shutter of claim 9, wherein the radius of the plurality of slats increases the further away from the spindle.

11. The rolling shutter of claim 7, wherein each bend between each body and each hooking track has a respective angle, and the angle of the proximal slat is smaller than the angle of the distal slat.

12. The rolling shutter of claim 11, wherein the respective angles of the slats increases as the slats get further away from the spindle.

13. The rolling shutter of claim 6, wherein at least one winding comprises a series of slats having an initial slat positioned closest to the spindle and a last slat positioned furthest from the spindle, and wherein the hooking track of the initial slat is overlapped by the body of the last slat and is adjacent to the receiving track of the last slat.

14. The rolling shutter of claim 6, wherein each of the windings comprises the same number of slats.

15. The rolling shutter of claim 6, wherein each of the windings comprises 5 slats.

16. A rolling shutter, comprising:

first and second slats, each slat comprising:

a single-walled body having a curvature with a radius of curvature, a convex outward facing side and a concave inward facing side, a first end and a second end, the convex side having a first surface with a first surface curvature;

a hooking track positioned at the first end, the hooking track having an outer second surface;

a bend formed between the body and the hooking track, wherein the hooking track projects outward above the convex side of the body and does not extend inward below the concave side of the body;

a receiving track positioned at the second end, the receiving track including a guard member extending along the curvature of the body and a lip member projecting inward below the concave side of the body, the guard member having an outer third surface; and an articulation space defined between the lip member and guard member, the articulation space sized and shaped to hingedly engage the hooking track;

wherein the hooking track of the first slat is engaged in the receiving track of the second slat, and the first and second slats having a vertical position wherein the second surface of the first slat does not project beyond a tangent to the third surface of the second slat.

17. The rolling shutter of claim 16, further comprising a hinge formed by engagement of the hooking track of the first slat in the receiving track of the second slat, and wherein the second and third surfaces form a hinge surface that extends along the first surface curvature.

18. A rolling shutter, comprising:

a spindle a plurality of slats, each slat comprising:

a single-walled body having a curvature with a radius of curvature, a convex outward facing side and a concave inward facing side, a first end and a second end;

a hooking track positioned at the first end;

a bend formed between the body and the hooking track, the hooking track projecting outward above the convex side of the body;

a receiving track positioned at the second end, the receiving track including a guard member extending along the curvature of the body, and a lip member projecting inward below the concave side of the body; and an articulation space defined between the lip member and guard member, the articulation space sized and shaped to hingedly engage the hooking track;

wherein the rolling shutter has a retracted position with the plurality of slats wound about the spindle in a first winding and a second successive winding, and wherein the body of a slat in the first winding is positioned adjacent to the body of a slat in the second winding.

* * * * *